United States Patent [19]

Armbruster

[11] Patent Number: 4,824,393

[45] Date of Patent: Apr. 25, 1989

[54] SOCKETLESS LIGHT BULB HOLDER

[76] Inventor: Joseph M. Armbruster, 2700 N. E. 47th St., Lighthouse Point, Fla. 33064

[21] Appl. No.: 884,518

[22] Filed: Jul. 11, 1986

[51] Int. Cl.[4] ..... H01R 13/625

[52] U.S. Cl. ..... 439/332; 439/611

[58] Field of Search ..... 339/88 R, 91 L, 125 L, 339/176 L, 189 L, 191 L, 50 R, 52 R, 52 S, 53, 54, 56; 439/332–338, 671–674, 611

[56] References Cited

U.S. PATENT DOCUMENTS

| | | | |
|---|---|---|---|
| 1,967,878 | 7/1934 | Geiger et al. | 339/176 L |
| 2,288,376 | 6/1942 | Tuppen | 339/52 R |
| 2,430,602 | 11/1947 | DeBell | 339/52 S |

FOREIGN PATENT DOCUMENTS

| | | | |
|---|---|---|---|
| 2361314 | 6/1974 | Fed. Rep. of Germany | 339/88 R |
| 600120 | 3/1948 | United Kingdom | 339/53 |

*Primary Examiner*—John McQuade

*Attorney, Agent, or Firm*—Fleit, Jacobson, Cohn & Price

[57] ABSTRACT

A socketless light bulb holder in the form of a substantially rigid, plastic bracket including a base affixed to a supporting structure with a generally centrally disposed mounting screw and a pair of terminal screws. The holder also includes a bulb holder portion snugly embracing the base of a light bulb. The terminals on the base of the light bulb are connected to conductor members extending from the terminals on the base of the light bulb to the terminal screws on the base of the holder with the conductor members being soldered to the terminals on the base of the light bulb thereby eliminating the necessity of the light bulb being inserted into and twisted in relation to a light bulb socket in order to mount the light bulb in the socket. In one embodiment of the invention, the holder includes a locking retainer for engagement with one of the bayonet pins which conventionally project radially from the base of the light bulb to mechanically lock the bulb in position. In another embodiment, the holder which snugly engages the base of the light bulb is provided wiht a slot enabling passage of one of the radially extending pins on the base of the light bulb. The positive soldered connection between the light bulb terminals and the conductor members eliminates points of corrosion which frequently results in the electrical energy supplied to the light bulb becoming interrupted.

6 Claims, 1 Drawing Sheet

FIG. 1
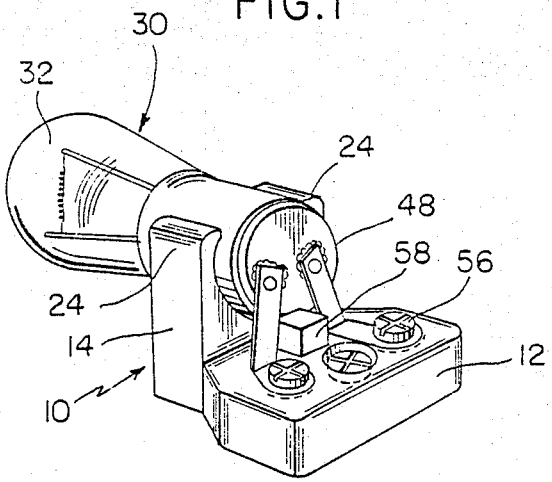
FIG. 2
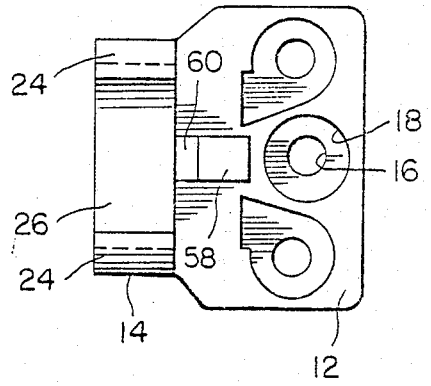
FIG. 3
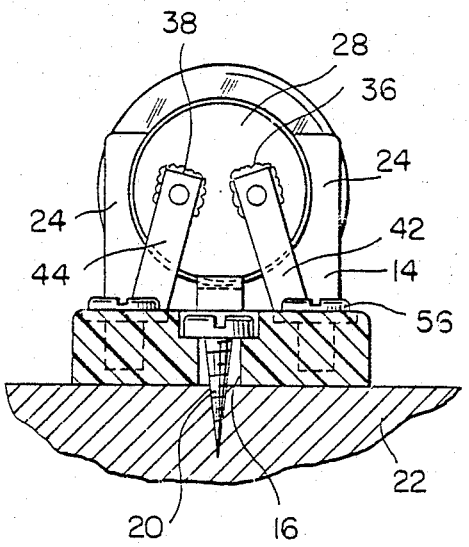
FIG. 4
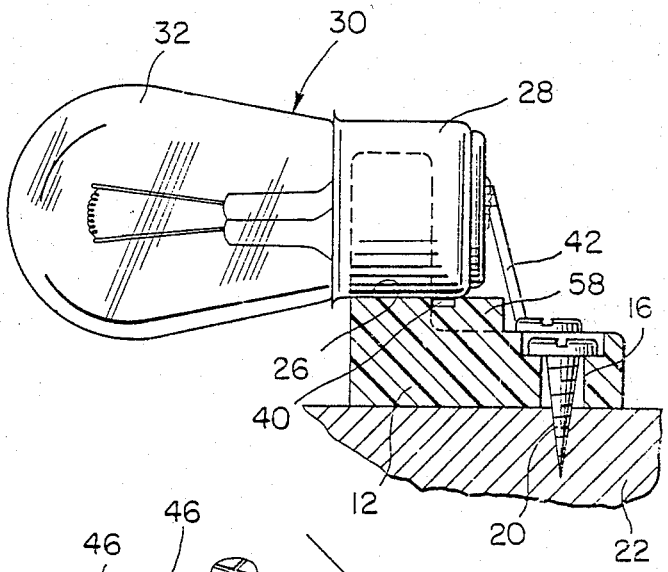
FIG. 6
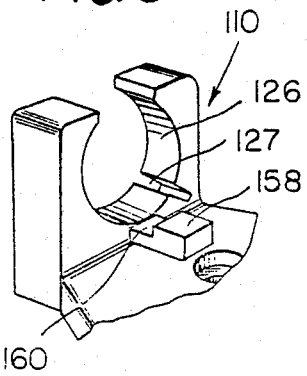
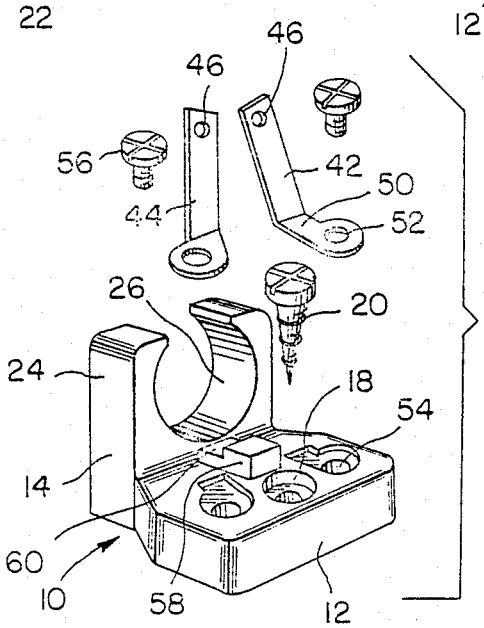
FIG. 5

SOCKETLESS LIGHT BULB HOLDER

BACKGROUND OF THE INVENTION

Field of the Invention

The present invention generally relates to a socketless light bulb holder and more particularly a substantially rigid, plastic bracket having a base portion for attachment to a supporting structure and a bulb holding portion which includes a partially circular recess receiving the base of a light bulb with the terminals on the base of the light bulb being soldered to a pair of conductor members that extend from the terminals on the base of the light bulb to a pair of terminal screws on the base of the light bulb holder.

Another object of the invention is to provide a light bulb holder in accordance with the preceding object in which all electrical connections with the light bulb are securely maintained with the conductor members being soldered to the terminals on the base of the light bulb which enables conventional and commercially available light bulbs to be used with the holder of the present invention with the positive connection reducing the possibly of corrosion occurring thereby prolonging the effective useful life of the light bulb especially in environments conducive to the formation of corrosion such as in marine use.

A further object of the invention is to provide a socketless light bulb holder in accordance with the preceding object in which the holder includes a structure for lockingly engaging and retaining one of the bayonet pins normally projecting radially from the base of a conventional light bulb.

Still another object of the invention is to provide a light bulb holder in accordance with the preceding objects in which the portion of the holder which engages the base of the light bulb includes a slot receiving one of the bayonet pins on the base of the light bulb.

A still further object of the invention is to provide a light bulb holder in accordance with the preceding objects in which the light bulb holder is provided with a notch in a retainer at the juncture between the base portion and the portion which receives and engages the base of the light bulb to engage and retain the bayonet pin extending radially from a conventional light bulb base.

Yet another important object of the present invention is to provide a socketless light bulb holder which is simple in construction, easy to install, effective in securely mounting light bulbs and connecting the light bulbs to a source of electrical energy while reducing the possibility of formation of corrosion thereby prolonging the useful life of the light bulb.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 1 is a perspective view of the light bulb holder of the present invention with a light bulb assembled in relation thereto.

FIG. 2 is a top plan view of the light bulb holder.

FIG. 3 is a transverse, sectional view of the light bulb holder illustrating the structure of the base and the manner in which it is mounted on a supporting surface.

FIG. 4 is a longitudinal, sectional view of the light bulb holder illustrating the structure which receives and retains the radial pin on the base of the light bulb.

FIG. 5 is an exploded group perspective view of the light bulb holder of the present invention.

FIG. 6 is a fragmental perspective view illustrating another embodiment of the light bulb holder.

DESCRIPTION OF THE PREFERRED EMBODIMENTS

Referring now specifically to FIGS. 1–5, the light bulb holder of the present invention is generally designated by numeral 10 and includes a base 12 and a bulb mount 14 which are oriented in perpendicular relation to each other and the holder is of one-piece, rigid construction of plastic material. The base includes a centrally disposed aperture 16 adjacent the edge thereof remote from the bulb mount 14 with the aperture 16 including a counterbored upper end 18 receiving a mounting screw 20 which is inserted into a supporting structure 22 so that the upper surface of the base 12 is substantially flush with the screw head being recessed in the counterbore 18. The bulb mount 14 includes a pair of upstanding side members 24 which are generally parallel to each other and define a partially cylindrical interior surface 16 which conforms with and snugly embraces the major portion of the base 28 of a light bulb generally designated by the numeral 30 and which includes the usual bulb 32 of transparent glass material or the like, filaments 34 disposed interiorly thereof and a pair of terminals 36 and 38 in the bottom of the base 28 which represents conventional bulb structure with these bulbs also including a pair of radially extending bayonet pins 40 intermediate the ends of the base 28 with the base 28 being constructed of conductive metal or the like and the terminals 36 and 38 being mounted in insulative material so that when the base of the bulb is conventionally inserted into a bayonet-type socket, the terminals will frictionally engage terminals in the socket.

In the present invention, a pair of conductor members 42 and 44 in the form of metal strips having small apertures 46 in the upper ends thereof are secured to the terminals 36 and 38 by soldering as indicated at 48 thereby providing a positive mechanical and electrical connection between the bulb base terminals 36 and 38 and the conductor members 42 and 44. The conductor members extend downwardly in diverging relation towards the base 12 of the holder and terminate in laterally extending arms or extensions 50 each of which is provided with an aperture 52 for overlying an internally screw threaded opening 54 in the base 12 so that terminal screws 56 may extend down through the aperture 52 and thread into the aperture or socket 54 in the base 12. A source of electrical energy having conductors are attached to the conductor members 42 and 44 by inserting a terminal end of each of the supply conductors under a respective terminal screw 56 thereby securely mechanically and electrically connecting the supply conductors to the conductor members 42 and 44 thereby providing a positive electrical connection for supplying electrical energy to the filaments 34 in the light bulb 30.

At the juncture between the base 12 and the bulb mount 14, an upwardly extending projection 58 is provided having a notch 60 therein adjacent the juncture with the partially cylindrical surface 26 to receive and engage one of the bayonet pins 40 on the base 28 of the light bulb 30, thereby locking the bulb 30 against rotational and reciprocal movement in relation to the bulb mount. This enables the bulb to be securely locked in position with the terminals 36 and 38 oriented in horizontal position by rotating the bulb 30 against frictional resistance produced by the snug engagement of the upwardly extending cylindrical portions of the cylindrical surface 26 with the base 28 of the light bulb 30. The other bayonet pin normally provided on the light bulb may be removed or may be retained as desired with the orientation of the pin 40 also serving to properly orient the terminals 36 and 38 and the filaments 34.

FIG. 6 illustrates a modified embodiment of the invention designated by numeral 110 in which the partially cylindrical surface 126 is provided with a radially extending slot 127 which received the radial pin 40 on the light bulb 30 so that the base of the light bulb may be inserted longitudinally through the partially cylindrical surface 126 after which it may be rotated to orient the terminals 36 and 38 horizontally and to engage the pin with the recess 160 in the projection 158. In this embodiment of the invention, the projection 158 and recess 160 may be omitted with the pin 40 merely frictionally engaging the inner surface of the bulb mount 14.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A holder for a light bulb having a cylindrical base provided with a pair of radially projecting pins and a pair of contact terminals in the bottom end of the base comprising a bracket constructed of rigid, non-conductive material and including a mounting base and bulb mount oriented in perpendicular relation, means mounting said mounting base from a supporting structure, said bulb mount including a pair of spaced members having partially cylindrical interior surfaces for frictionally receiving the cylindrical base of the light bulb and a pair of conductor members attached to the mounting base and extending to the proximity of the pair of terminals on the light bulb supported by the holder for connection thereto, said mounting base including means for locking the base of the bulb thereto.

2. The light bulb holder of claim 1 wherein said locking means includes a projection on the bracket forming an extension from one side of one of said partially cylindrical interior surfaces, said projection including a lateral notch receiving one of the radial pins on the base of the light bulb when the bulb is inserted into the bulb mount and twisted.

3. The light bulb holder of claim 1 wherein each of said conductor members includes an eye on the end thereof remote from the terminals on the base of the light bulb, and terminal screws extending through the eyes into the mounting base of the holder, said terminal screws adapted to retain electrical supply conductors connected with the conductor members.

4. A holder for a light bulb having a cylindrical base provided with a pair of radially projecting pins and a pair of contact terminals in the bottom end of the base comprising a bracket constructed of rigid, non-conductive material and including a mounting base and bulb mount oriented in perpendicular relation, means mounting said mounting base from a supporting structure, said bulb mount including a pair of spaced members having partially cylindrical interior surfaces for frictionally receiving the cylindrical base of the light bulb and a pair of conductor members attached to the mounting base and extending to the proximity of the pair of terminals on the light bulb supported by the holder for connection thereto, said bracket including means for locking the base of the bulb thereto, said locking means including a slot in the interior surface of one of said spaced members to enable passage of one of the radial pins on the base of the light bulb for twisting of the base of the bulb to lock the pin against the bulb mount.

5. In combination, a light bulb with a cylindrical base having a pair of spaced terminals on the end thereof, a socketless light bulb holder comprising a rigid bracket having a mounting base and a bulb mounting portion oriented in perpendicular relation, said bulb mounting portion including a partial cylindrical internal surface frictionally and securely securing the bulb base in the partial cylindrical internal surface on the bulb mounting portion, and a pair of conductor members soldered to the terminals on the end of the bulb, said conductor members extending to and being secured to said mounting base for connection with electrical supply conductors, said cylindrical base on the light bulb and the mounting base on said holder including coacting means to prevent axial movement of the cylindrical base on the light bulb in relation to the holder.

6. The combination as defined in claim 5 wherein said coacting means preventing axial movement of the cylindrical base on the bulb in relation to the holder includes at least one radial pin on the cylindrical base of the bulb, said mounting base of the holder including a groove facing the cylindrical base of the bulb when the base of the bulb is secured in the partial cylindrical internal surface on the bulb mounting portion with the groove receiving the radial pin when the cylindrical base of the light bulb has been inserted into the partial cylindrical surface on the bulb mounting portion of the mounting base and twisted into registry with the groove, said groove having a width closely receiving the pin and preventing axial movement of the pin and cylindrical base of the light bulb, and a soldered connection between the conductor members and terminals on the end of the base of the light bulb preventing twisting movement of the cylindrical base of the light bulb after assembly of the light bulb with the holder and soldering of the conductor members to the terminals on the end of the cylindrical base of the light bulb.

* * * * *